US007137719B2

(12) United States Patent
Wu

(10) Patent No.: US 7,137,719 B2
(45) Date of Patent: Nov. 21, 2006

(54) COMPOSITE SERIAL LAMP SET

(76) Inventor: Jeng-Shyong Wu, No. 14, Alley 1, Lane 326, Shyr-Piin Road, Hsin-Chu City (TW)

( * ) Notice: Subject to any disclaimer, the term of this patent is extended or adjusted under 35 U.S.C. 154(b) by 125 days.

(21) Appl. No.: 10/844,020

(22) Filed: May 12, 2004

(65) Prior Publication Data

US 2005/0254231 A1 Nov. 17, 2005

(51) Int. Cl.
*F21S 13/14* (2006.01)

(52) U.S. Cl. ..... 362/252

(58) Field of Classification Search ..... 362/252; 174/28

See application file for complete search history.

(56) References Cited

U.S. PATENT DOCUMENTS 5,601,361 A * 2/1997 Lawrence ..... 362/249
5,716,124 A * 2/1998 Hsu ..... 362/252
6,126,298 A * 10/2000 Wu ..... 362/252
6,302,562 B1 * 10/2001 Wu ..... 362/252
6,545,222 B1 * 4/2003 Yokokawa et al. ..... 174/110 R
6,570,087 B1 * 5/2003 Navone et al. ..... 174/28
2003/0217864 A1 * 11/2003 Ishikawa et al. ..... 174/135

* cited by examiner

*Primary Examiner*—Ali Alavi
*Assistant Examiner*—William J Carter
(74) *Attorney, Agent, or Firm*—McGlew & Tuttle, PC

(57) ABSTRACT

A composite serial lamp set includes one or more non-electrical connector assembled with a serial lamp set, and the non-electrical connector is formed by tying a plurality of strands into a bundled wire and wrapping the bundles wire with a jacket layer to constitute a string-like sheath wire. There is a twisting of the non-electrical connector with the serial lamp set into a fixed position. The composite serial lamp set in can be of various patterns and shapes such as linear, circular, triangular, rhombus, or square. The composite serial lamp set is solid and durable.

42 Claims, 7 Drawing Sheets

COMPOSITE SERIAL LAMP SET

BACKGROUND OF THE INVENTION

1. Field of the Invention

The present invention relates to a decorative composite serial lamp set, which could be of various patterns and shapes such as a linear, a circular, a triangular, a rhombus, and a square shape, and the composite serial lamp set is solid and durable.

2. Description of the Related Art

The conventional decorative serial lamps such as a Christmas serial lamp set that connects many small light bulbs together, and the small lamps are separated from each other at a specific interval and extended continuously to a predetermine length. In recent years, since various bright light emitting diodes (LED) with different colors have been developed, the LED can be used to substitute the small light bulbs to form a serial lamp set. Traditionally, such serial lamp set is wrapped around an indoor or outdoor tree or fence or hung on a wall for decoration. An eye-catching artistic effect is produced, particularly when these light emitting devices are controlled to blink at nighttime.

However, the light bulbs of traditional serial lamps are supported by the electric wire, and the electric wire is made of copper wire and wrapped by a plastic layer wrap (where the positive and negative wires are put into a single electric wire). Thus, when the serial lamp set is very large in size, the electric wire cannot bear the heavy weight and has the risk of being not solid or durable enough for the safety purpose. Since the electric wire is a single wire, therefore it requires a two-dimensional space or even a three-dimensional space to show a specific pattern such as a grid pattern, which makes it very difficult to show such patterns, shapes, or styles. Even though many sets of serial lamps are used for designing such patterns, the implementation is still very difficult and usually causes the serial lamp set to be tangled together, and thus it is troublesome to install or remove such serial lamp set.

SUMMARY OF THE INVENTION

The primary objective of the present invention is to provide a composite serial lamp set to overcome the foregoing shortcomings of the prior-art technology. The composite serial lamp set of the invention comprises a non-electrical connector connected in series to form various patterns and shapes such as a linear, a circular, a triangular, a rhombus, a square shape or any specific shape including a three-dimensional shape. The non-electrical connector plays a role of the supporting material. Unlike the non-electrical connector, the conductive wire also plays the role of conducting electricity. Since the non-electrical connector comprises a plurality of strands to form a bundled wire, and such bundled wire is wrapped by a jacket layer, therefore the non-electrical connector is much stronger and flexible than the serial conductive wire and can support the lamp set with various shapes or combine with the serial lamp to form various patterns and shapes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
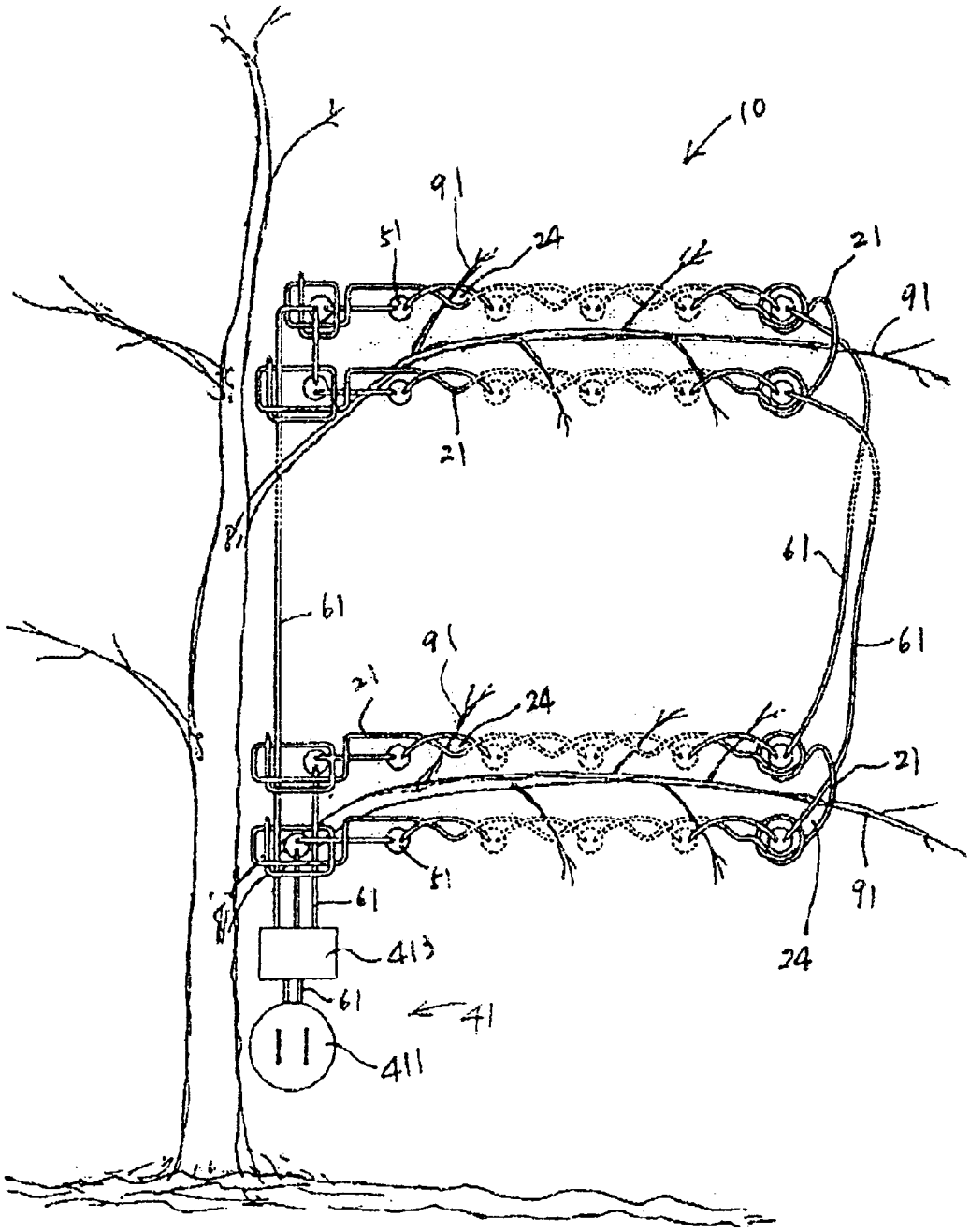
FIG. 1 is a side schematic view of the application of the composite serial lamp set according to the present invention.

The assemly and implementation of the composite serial lamp set in accordance with the present invention includes a composite serial lamp set which comprises at least one non-electrical connector coupled with a serial lamp, and the non-electrical connector is comprised of a plurality of strands to define a bundled wire, and the bundled wire is wrapped by a jacket layer to define a string-like sheath wire, and the non-electrical connector and the serial lamp are stranded together and set into a fixed position.

The non-electrical connector may adopt a single strand or a jacket layer as an insulating material. The insulating material could be polyethylene (PE), polypropylene (PP,) nylon, polyvinyl chloride (PVC), cotton, or jute.

The bundled wire advantageously comprises a plurality of strands aligned in parallel with each other. The bundled wire may comprise a plurality of single strands stranded with each other and the bundled wire may comprise a plurality of stranded bundled wires.

The non-electrical connector may be comprised of a plurality of sheath wires. The sheath wires may be stranded with each other.

The power supply device and a plurality of light emitting devices are coupled with each other in parallel or in series. The power supply device includes a plug, a rear socket, or a function controller. The light emitting device is comprised of an insulating base and a tungsten light bulb or a light emitting diode (LED).

The composite serial lamp set comprises a plurality of single conductive wires and a plurality of light emitting devices serially coupled with each other, and the single conductive wire and the non-electrical connector are stranded and wound together. The composite serial lamp set may comprise a plurality of parallel conductive wires and a plurality of serial light emitting devices that are stranded and wound together with the plurality of conductive wires and non-electrical connectors. At least one non-electrical connector advantageously can comprise a plurality of positions for fixing the plurality of light emitting devices of the serial lamp set for forming a linear, a circular, a triangular, a rhombus, a square, or a predetermined pattern and text. The non-electrical connector may be tied at the base of a light emitting device or the base of a conductive wire. The non-electrical connector or the conductive wire may be fixed on a clamp of the light emitting device.

The non-electrical connector may be stranded together or coupled in parallel to form an opening between the bundled wires, and the light emitting device passes through the opening all the way to the base of the light emitting device and is coupled and fixed onto the conductive wire.

The composite serial lamp set may have the non-electrical connector fixed onto the conductive wire between the light emitting devices to arrange the light emitting devices in a linear, a circular, a triangular, a rhombus, a square, or a predetermined pattern and text.

The non-electrical connector may be tied and fixed onto the conductive wire. The non-electrical connector may be fixed onto the conductive wire by a clamp base. At least one conductive wire may be stranded and wound with at least one other non-electrical connector within a predetermined distance to define an opening, such that a support object passes through the opening and the support object is secured into a fixed position by the twisting force.

The support object may be a tree-shaped object. The decorative object may advantageously be installed onto the non-electrical connector or between the conductive wires.

The composite serial lamp comprises at least one non-electrical connector coupled to a serial lamp set, and the non-electrical connector comprises a plurality of strands to define a bundled wire, and an insulating jacket layer wraps around the bundled wire to define a string-like sheath wire, and the serial lamp set is comprised of at least one conductive wire connected to a plurality of light emitting devices and a power supply device in parallel or in series, therefore the non-electrical connectors and serial lamp set are stranded and wound into a fixed position to arrange the light emitting devices into a linear, a circular, a triangular, a rhombus, a square, or a predetermined pattern and text.

The non-electrical connector may adopt or employ a strand or a jacket layer as an insulating material. The insulating material is selected from PE, PP, nylon, PVC, cotton, or jute. The bundled wire may comprises a plurality of strands aligned in parallel with each other. The bundled wire may comprises a plurality of strands stranded with each other. The non-electrical connector may be comprised of a plurality of sheath wires stranded with each other. The non-electrical connector is comprised of a plurality of sheath wires stranded with each other. The non-electrical connector may be comprised of a plurality of sheath wires aligned in parallel with each other.

The power supply device is set up with a plurality of light emitting devices coupled with each other in parallel or in series. The power supply device may be one or more of a plug, a rear socket, or a function controller.

The light emitting device may be comprised of an insulating base and a tungsten light bulb or a light emitting diode (LED).

The composite serial-lamp set may comprise a serial lamp set that comprises a plurality of single conductive wires and a plurality of light emitting devices serially coupled with each other, and the single conductive wire and non-electrical connector are stranded and wound together. The composite serial lamp set may comprise a plurality of parallel conductive wires and a plurality of serial light emitting devices stranded and wound together. At least one non-electrical connector comprises a plurality of positions for fixing the plurality of the light emitting devices of the serial lamp set for forming a linear, a circular, a triangular, a rhombus, a square, or a predetermined pattern and text. The non-electrical connector may be tied at the base of a light emitting device or the base of a conductive wire. The non-electrical connector or the conductive wire may be fixed onto a clamp of the light emitting device.

The non-electrical connector may be stranded together or coupled in parallel to form an opening between the bundled wires, and the light emitting device passes through the opening all the way to the base of the light emitting device to be coupled and fixed onto the conductive wire. At least one non-electrical connector may be fixed onto the conductive wire between the light emitting devices to arrange the light emitting devices in a linear, a circular, a triangular, a rhombus, a square, and a predetermined pattern and text (a predetermined pattern). The non-electrical connector may be tied and fixed onto the conductive wire. The non-electrical connector is fixed onto the conductive wire by a clamp base.

At least one conductive wire may be stranded and wound with at least one other non-electrical connector within a predetermined distance to define an opening, such that a support object passes through the opening and the support object is secured into a fixed position by a twisting force. This support object may be a tree-shaped object. The composite serial lamp may further include a decorative object disposed on the non-electrical connector and wound between the conductive wires.

The non-electrical connector, coupled with a serial lamp strand or set, may comprise a plurality of strands to define a bundled wire, with an insulating jacket layer wrapping around the bundled wire to define a string-like sheath wire. The serial lamp set is comprised of a plurality of conductive wires connected to a plurality of light emitting devices and a power supply device, therefore the non-electrical connectors and serial lamp set are stranded and wound into a plurality of fixed positions on the serial lamp set to arrange the serial lamp set into a linear, a circular, a triangular, a rhombus, a square, and a predetermined pattern or text.

Referring to the drawings in particular FIG. 1 shows an embodiment of a composite serial lamp set according to the invention. The composite serial lamp set 10 is comprised of a power supply device 41 and a plurality of light emitting devices 51 serially coupled by a plurality of conductive wires 10. The power supply device includes a plug 411, a rear socket or a function controller 4J 3 and the support object 91 is a tree-shaped object. After the plug 411 is connected to electric power. The conductive wire 61 and the non-electrical connector 21 are stranded together by installing a conductive wire through the function controller 413 along the branch of the object 91. An opening 24 is disposed at a specific interval for being hung on the support object 91 and fixing the shape of the composite serial lamp set.

Referring to FIGS. 2A–2F the non-electrical connector may be embodied as shown for the composite serial lamp set according to preferred embodiments of the present invention.

Figure 2A:
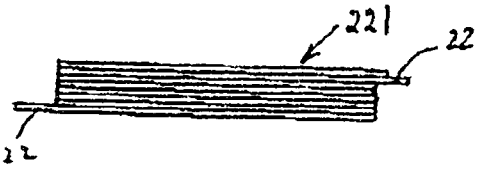
FIG. 2A is a side broken away view of the non-electrical connector strands disposed for the composite serial lamp set according to a preferred embodiment the present invention.
Figure 2B:
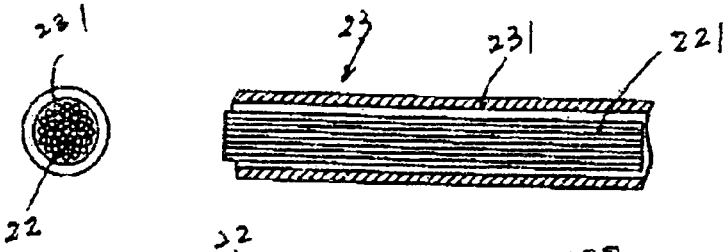
FIG. 2B is a side broken sectional view and end sectional view of the non-electrical connector strands disposed for the composite serial lamp set according to the embodiment of FIG. 2A.

In FIGS. 2A–2B, the bundled wire 221 is comprised of a plurality of strands aligned in parallel with each other and wrapped with an insulating material which constitutes the jacket layer 231. The jacket layer 231 material could be polyethylene (PE), polypropylene (PP), nylon, polyvinyl chloride (PVC), cotton, or jute.

Figure 2C:
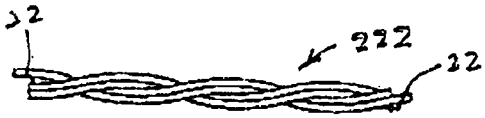
FIG. 2C is a side broken away view of the non-electrical connector strands disposed for the composite serial lamp set according to a preferred embodiment the present invention.
Figure 2D:
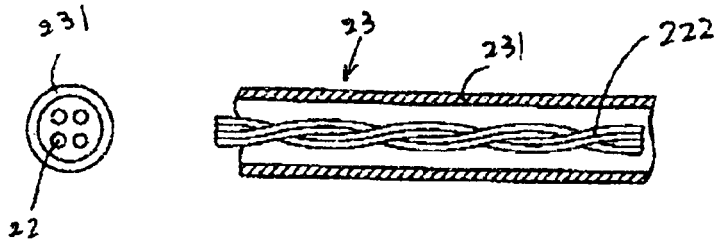
FIG. 2D is a side broken sectional view and end sectional view of the non-electrical connector strands disposed for the composite serial lamp set a preferred embodiment the present invention.

In FIGS. 2C–2D, the bundled wire 222 is comprised of a plurality of strands 22 stranded with each other and wrapped with the insulating material which is the jacket layer 231 The material could also be polyethylene (PE), polypropylene (PP), nylon, polyvinyl chloride (PVC), cotton, or jute.

Figure 2E:
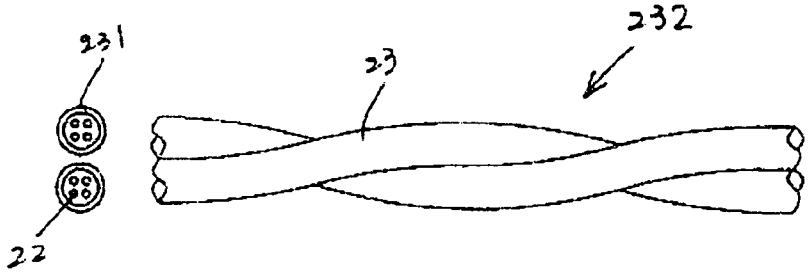
FIG. 2E is a side broken sectional view and end sectional view of the non-electrical connector strands disposed for the composite serial lamp set a preferred embodiment the present invention.
Figure 2F:
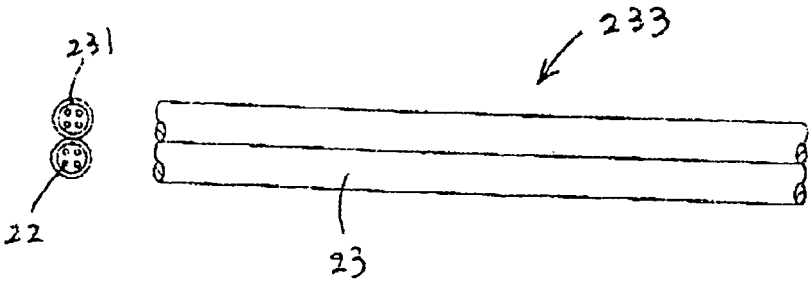

In FIG. 2E, the non-electrical connector 232 is made by twisting a plurality of sheath wires 23. In FIG. 2F, the non-electrical connector 233 is made by connecting a plurality of sheath wires 23 in parallel.

Figure 3A:
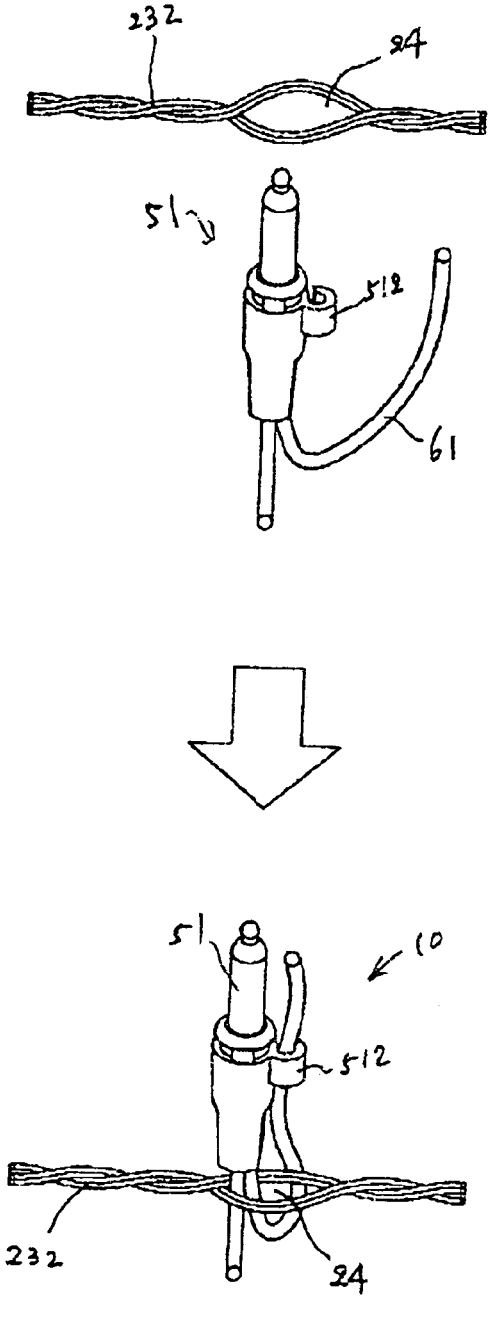
FIG. 3A is a view showing the light emitting device and non-electrical connector being combined into the composite serial lamp set according to a preferred embodiment of the present invention.
Figure 3B:
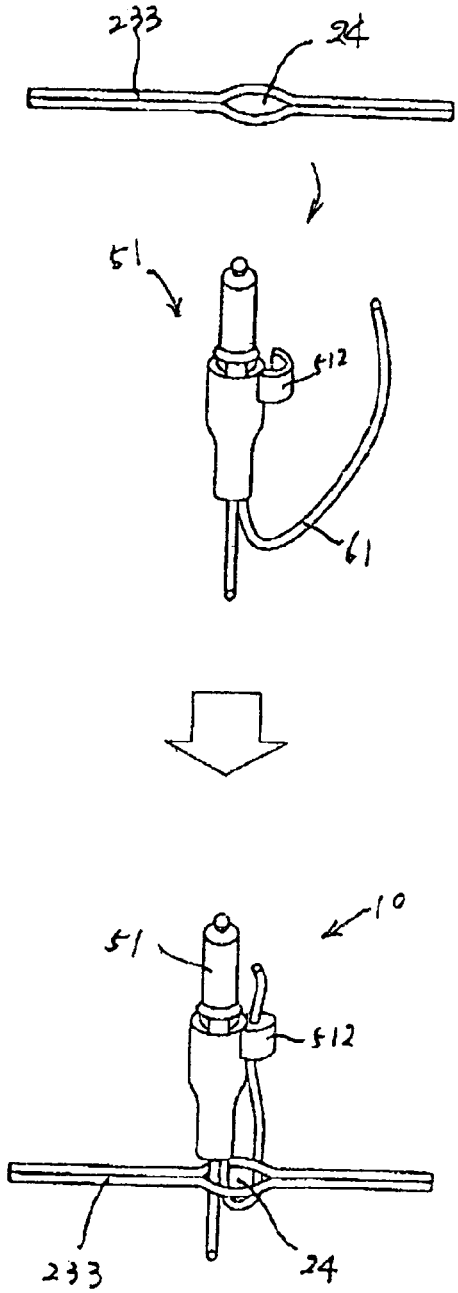
FIG. 3B is a view showing the light emitting device and non-electrical connector being combined into the composite serial lamp set according to a preferred embodiment of the present invention.

Referring to FIGS. 3A–3B the light emitting device and the non-electrical connector are connected in the composite serial lamp set according to a preferred embodiment of the present invention.

In FIG. 3A, an opening 24 is formed by the stranded sheath wire of the non-electrical connector 232 at a specific interval between the bundled wires. A light emitting device 51 has a clamp disposed at the middle section of the light emitting device 51 for mounting the non-electrical connector or the conductive wire 512. Therefore, the light emitting device 51 passes through the opening 24 and to connect and fix the base of the light emitting device 51 onto other conductive wire 1.

Figure 4:
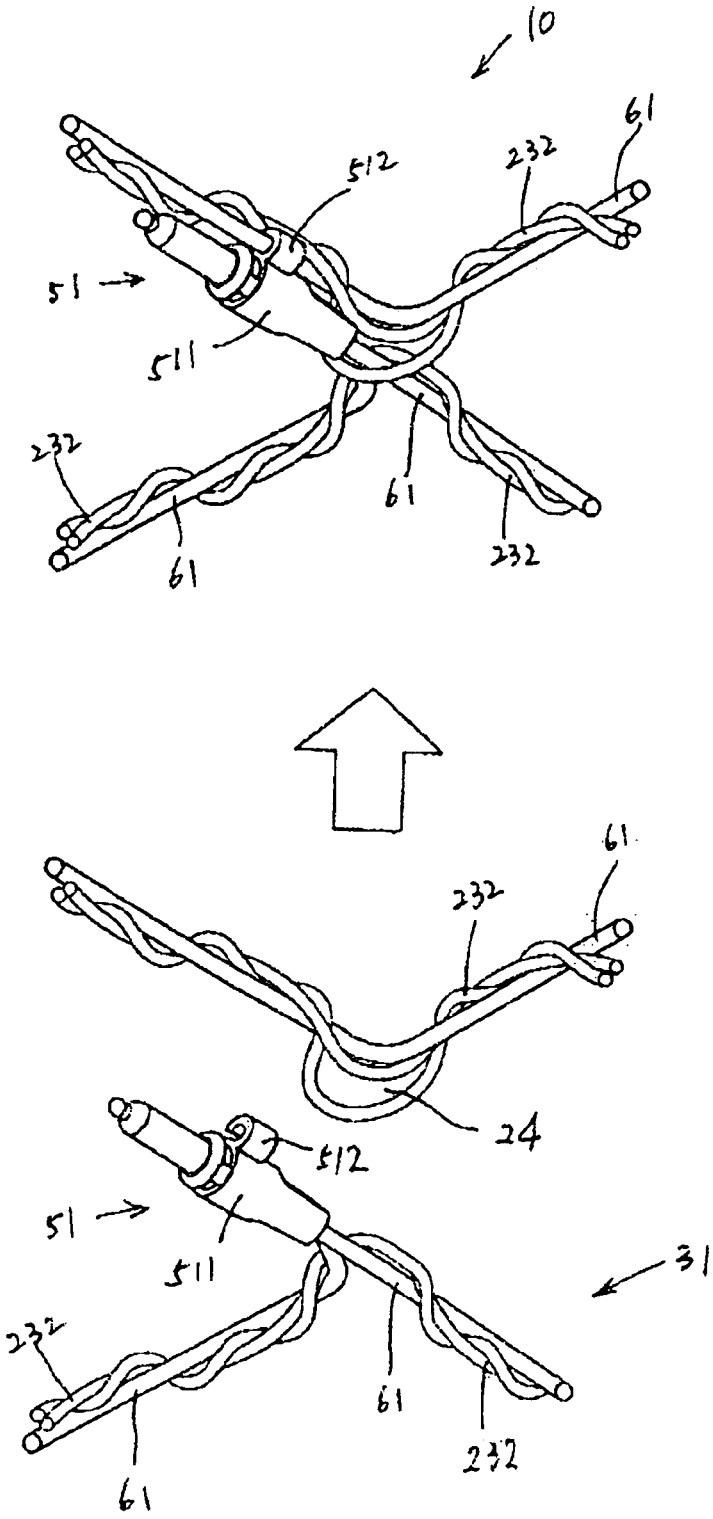
FIG. 4 is a view of the light emitting device, non-electrical connector, light emitting device, and conductive wire being combined into the composite serial lamp set according to a first embodiment of the present invention.

Referring to FIG. 4, the non-electrical connector, the light emitting device, and the conductive wire are shown combined into the composite serial lamp set; wherein the combination is divided into two sections. The first section relates to the serial lamp set 31, and the conductive wire 61 is connected to the light emitting device 51 on an insulator 511 and then wound with the non-electrical connector. The second section relates to the conductive wire 61. The non-electrical connector 232 being stranded and wound into an obtuse angle, and the non-electrical connector being disposed at the opening 24 within the obtuse angle. The conductive wire 61 of the second section is fixed on a hanging hook 512, and the non-electrical connector 232 of the second section causes the opening to contract due to the rebounding force. The first and second sections constitute a safe composite serial lamp set 10.

Figure 5:
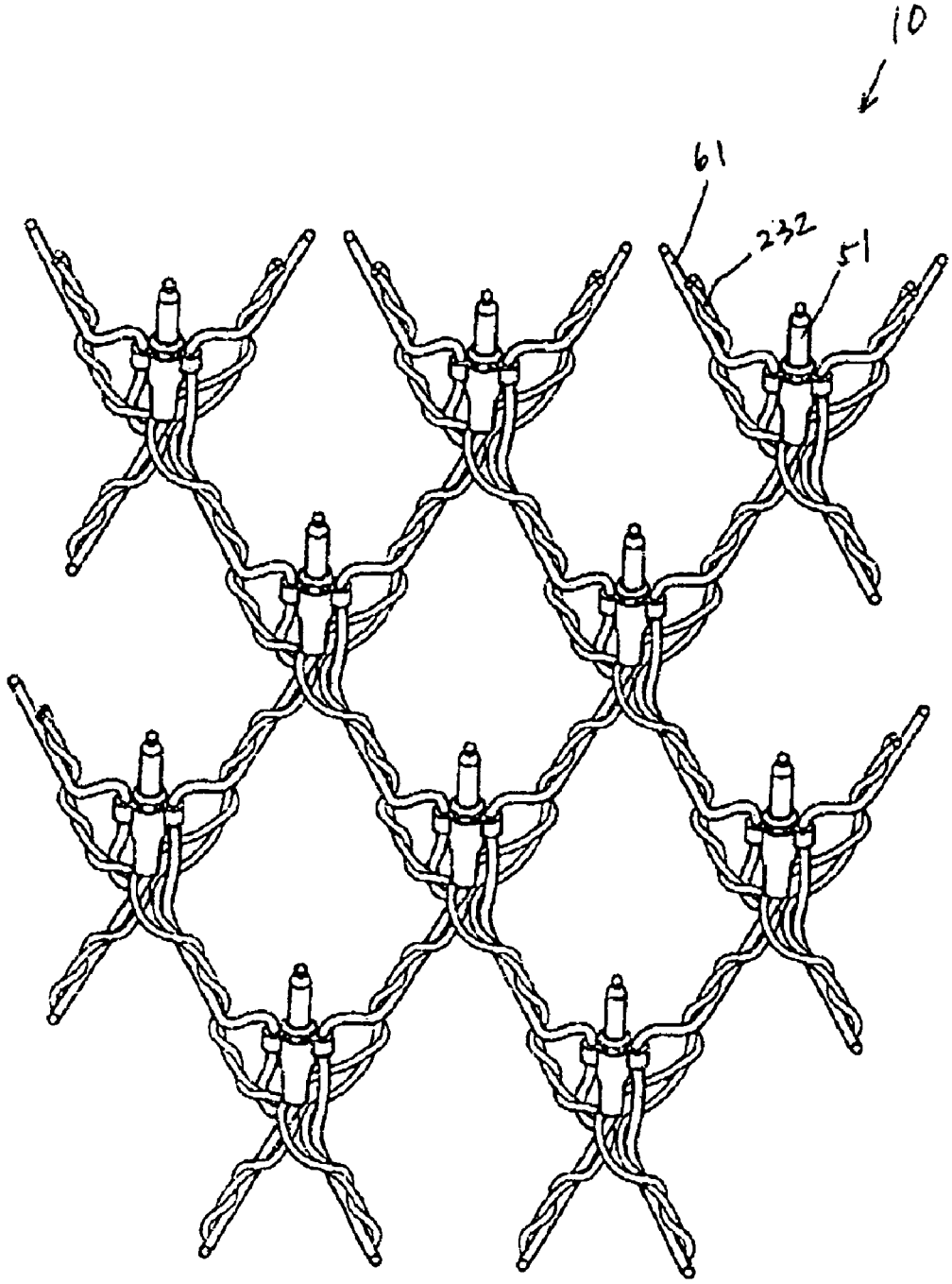
FIG. 5 is a view of the light emitting device, non-electrical connector, light emitting device, and conductive wire being combined into the composite serial lamp set according to a second embodiment of the present invention.

Referring to FIG. 5, for the non-electrical connector, the light emitting device, and the conductive wire are combined into the composite serial lamp set according to another preferred embodiment of the invention. The non-electrical connectors 232, 233 and the conductive wire 61 are combined to make the composite serial lamp set into a rhombus grid form and the light emitting device 51 comprises two hanging hooks at its middle.

Figure 6:
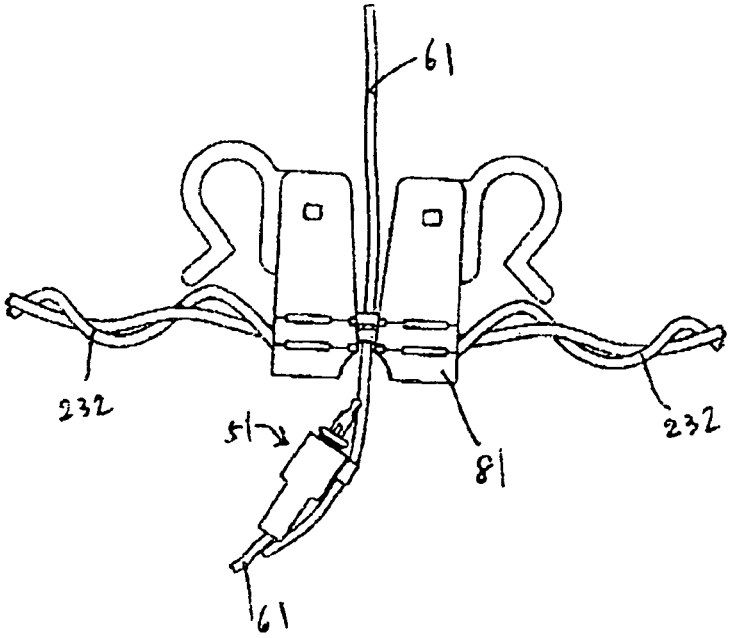
FIG. 6 is a view of the light emitting device, non-electrical connector, light emitting device, and conductive wire being combined into the composite serial lamp set according to a third embodiment of the present invention.

Referring to FIG. 6, for the non-electrical connector, the light emitting device, and the conductive wire are combined into the composite serial lamp set according to another preferred embodiment of the invention, A clamp base 81 secures the non-electrical connectors 232, 233 and the conductive wire 61 into a fixed position to form the expected overall shape.

Figure 7:
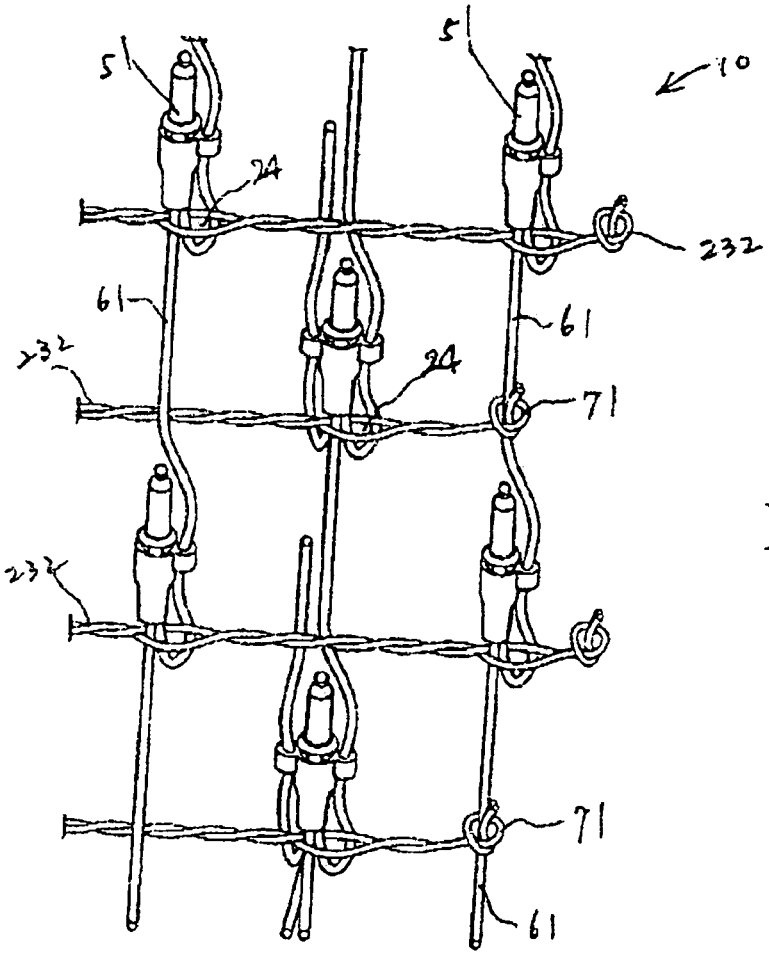
FIG. 7 is a view of the light emitting device, non-electrical connector, light emitting device, and conductive wire being combined into the composite serial lamp set according to a fourth embodiment of the present invention.

Referring to FIG. 7, for the non-electrical connector, the light emitting device, and the conductive wire are combined into the composite serial lamp set according to a further preferred embodiment of the invention. The non-electrical connectors 232, 233 and the conductive wire 61 are combined to make the composite serial lamp set into a square grid form and fixed by tying knots.

Figure 8:
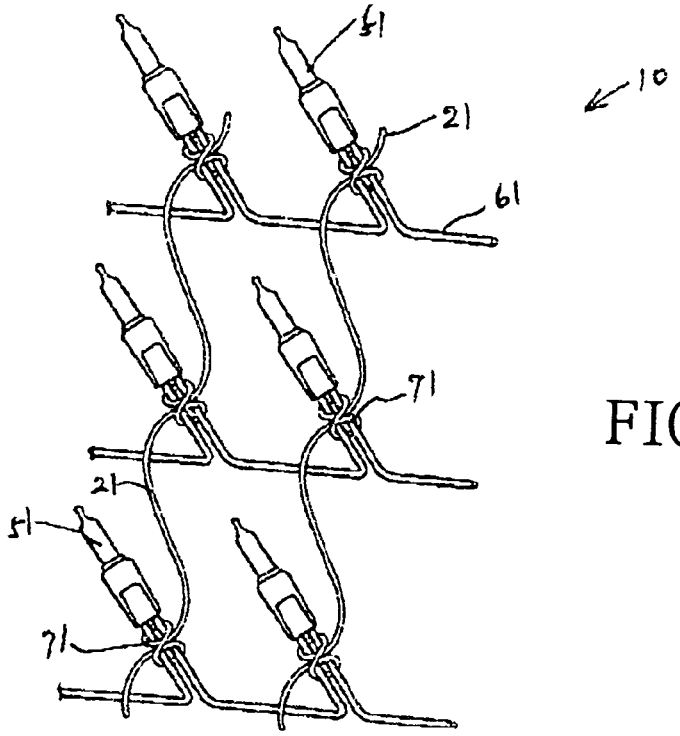
FIG. 8 is a view of the light emitting device, non-electrical connector, light emitting device, and conductive wire being combined into the composite serial lamp set according to a fifth embodiment of the present invention.

Referring to FIG. 8, for the non-electrical connector, the light emitting device, and the conductive wire are combined into the composite serial lamp set according to another further preferred embodiment of the invention. The non-electrical connector 21 is tied to the base where the non-electrical connector 21 disposed at the light emitting device 51 and the conductive wire 61 are connected and fixed by tying a knot 71.

Figure 9:
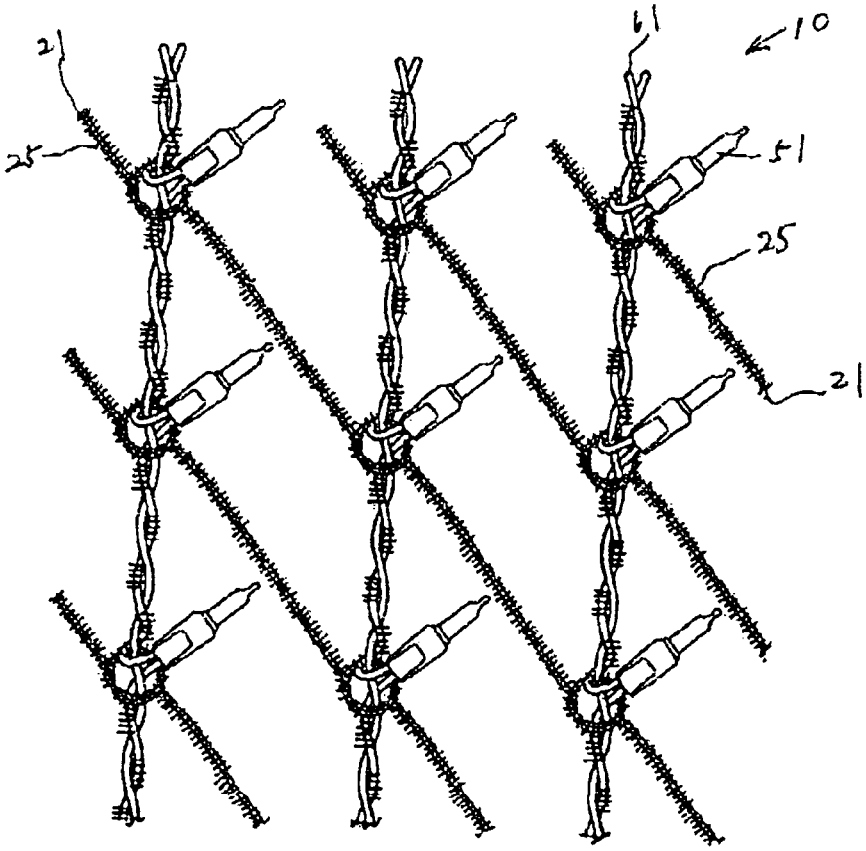
FIG. 9 is a view of the light emitting device, non-electrical connector, light emitting device, and conductive wire being combined into the composite serial lamp set according to a sixth embodiment of the present invention.

Referring to FIG. 9, for the non-electrical connector, the light emitting device, and the conductive wire are combined into the composite serial lamp set according to another preferred embodiment of the invention. A decorative object 25 is added at a position where the non-electrical connector 21 is wound around the conductive wire 61.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A composite serial lamp set, comprising:

a serial lamp set with electrical conductors and a plurality of light emitting devices;

at least one non-electrical connector coupled with said serial lamp set, and said non-electrical connector being comprised of a plurality of strands to define a bundled wire, and said bundled wire being wrapped by a jacket layer to define a sheath wire, and said non-electrical connector and said serial lamp set being selectively stranded together to define a plurality of positions with an opening, with each opening being formed between one or more of said non-electrical connector and at least one other non-electrical connector, said bundled wires and said stranded together non-electrical connector and said serial lamp set and with at least some of said light emitting devices passing through a respective said opening all the way to the base of the light emitting device to be coupled and fixed onto said conductive wire.

2. The composite serial lamp set as claimed in claim 1, wherein said non-electrical connector selectively uses a single strand and a jacket layer as an insulating material, which is one selected from a collection of PE, PP, nylon, PVC, cotton, and jute.

3. The composite serial lamp set as claimed in claim 1, wherein said bundled wire comprises a plurality of strands aligned in parallel with each other.

4. The composite serial lamp set as claimed in claim 1, wherein said bundled wire comprises a plurality of strands stranded with each other.

5. The composite serial lamp set as claimed in claim 4, wherein said non-electrical connector is comprised of a plurality of sheath wires stranded with each other.

6. The composite serial lamp set as claimed in claim 5 wherein said non-electrical connector is tied selectively at the base of a light emitting device and at the base of a conductive wire.

7. The composite serial lamp set as claimed in claim 1, wherein said non-electrical connector is comprised of a plurality of sheath wires stranded with each other.

8. The composite serial lamp set as claimed in claim 1, wherein said non-electrical connector is comprised of a plurality of sheath wires aligned in parallel with each other.

9. The composite serial lamp set as claimed in claim 1, wherein comprising a power supply device and a plurality of light emitting devices coupled with each other selectively in parallel and in series.

10. The composite serial lamp set as claimed in claim 9, wherein said power supply device is one selected from the collection of a plug, a rear socket, and a function controller.

11. The composite serial lamp set as claimed in claim 9, wherein said light emitting device is comprised of an insulating base and selectively a tungsten light bulb and a light emitting diode (LED).

12. The composite serial lamp set as claimed in claim 1, wherein said composite serial lamp set comprises a plurality of single conductive wires and a plurality of light emitting devices serially coupled with each other, and said single conductive wire and said non-electrical connector are stranded and wound together.

13. The composite serial lamp set as claimed in claim 1, wherein said composite serial lamp set comprises a plurality of parallel conductive wires and a plurality of serial light emitting devices are stranded and wound together with said plurality of conductive wires and said non-electrical connectors.

14. The composite serial lamp set as claimed in claim 1, wherein said plurality of positions form a pattern.

15. The composite serial lamp set as claimed in claim 13, wherein said non-electrical connector is tied selectively at the base of a light emitting device and at the base of a conductive wire.

16. The composite serial lamp set as claimed in claim 1, wherein said non-electrical connector and said conductive wire are fixed selectively on a clamp of said light emitting device.

17. The composite serial lamp set as claimed in claim 1, wherein said at least one non-electrical connector is fixed onto said conductive wire between said light emitting devices to arrange said light emitting device selectively in a predetermined pattern.

18. The composite serial lamp set as claimed in claim 17, wherein said non-electrical connector is tied and fixed onto said conductive wire.

19. The composite serial lamp set as claimed in claim 17, wherein said non-electrical connector is fixed onto said conductive wire by a clamp base.

20. The composite serial lamp set as claimed in claim 1, wherein further comprising a decorative object disposed on said non-electrical connector and wound between said conductive wires.

21. A composite serial lamp set, comprising:

at least one non-electrical connector coupled with a serial lamp set, and said non-electrical connector being comprised of a plurality of strands to define a bundled wire, and said bundled wire being wrapped by a jacket layer to define a sheath wire, and said non-electrical connector and said serial lamp set being stranded together and fixed into a position, wherein said at least one conductive wire is stranded and wound with at least one other non-electrical connector within a predetermined distance to define an opening, such that a support object passes through said opening and said support object is secured into a fixed position by a twisting force.

22. The composite serial lamp set as claimed in claim 21, wherein said support object is a tree shaped object.

23. A composite serial lamp set, comprising at least one non-electrical connector coupled with a serial lamp set, and said non-electrical connector comprising a plurality of strands to define a bundled wire, and an insulating jacket layer wrapping around said bundled wire to define a string-like sheath wire, and said serial lamp set is comprised of at least one conductive wire connected to a plurality of light emitting devices and a power supply device selectively in parallel and in series, thereby said non-electrical connectors and serial lamp set are stranded and wound into a fixed position, with a plurality of positions being provided for fixing said plurality of light emitting devices of said serial lamp set for selectively forming a predetermined pattern, wherein said non-electrical connector is selectively stranded together and coupled in parallel to form an opening between said bundled wires, and said light emitting device passes through said opening all the way to the base of the light emitting device to be coupled and fixed onto said conductive wire.

24. The composite serial lamp set as claimed in claim 23, wherein said non-electrical connector selectively employs a strand and a jacket layer as an insulating material, and said insulating material is one selected from the collection of PE, PP, nylon, PVC, cotton or jute.

25. The composite serial lamp set as claimed in claim 23, wherein said bundled wire comprises a plurality of strands aligned in parallel with each other.

26. The composite serial lamp set as claimed in claim 23, wherein said bundled wire comprises a plurality of strands stranded with each other.

27. The composite serial lamp set as claimed in claim 26, wherein said non-electrical connector is comprised of a plurality of sheath wires stranded with each other.

28. The composite serial lamp set as claimed in claim 23, wherein said non-electrical connector is comprised with a plurality of sheath wires stranded with each other.

29. The composite serial lamp set as claimed in claim 23, wherein said non-electrical connector is comprised of a plurality of sheath wires aligned in parallel with each other.

30. The composite serial lamp set as claimed in claim 23, wherein further comprising a power supply device and a plurality of light emitting devices coupled with each other selectively in parallel and in series.

31. The composite serial lamp set as claimed in claim 30, wherein said power supply device is one selected from the collection of a plug, a rear socket, and a function controller.

32. The composite serial lamp set as claimed in claim 30, wherein said light emitting device is comprised of an insulating base and selectively a tungsten light bulb and a light emitting diode (LED).

33. The composite serial lamp set as claimed in claim 23, wherein said composite serial lamp set comprises a plurality of single conductive wires and a plurality of light emitting devices serially coupled with each other, and said single conductive wire and said non-electrical connector are stranded and wound together.

34. The composite serial lamp set as claimed in claim 23, wherein said composite serial lamp set comprises a plurality of parallel conductive wires and a plurality of serial light emitting devices stranded and wound together.

35. The composite serial lamp set as claimed in claim 23, wherein said non-electrical connector and said conductive wire are fixed selectively on a clamp of said light emitting device.

36. The composite serial lamp set as claimed in claim 23, wherein said at least one non-electrical connector is fixed onto said conductive wire between said light emitting devices to arrange said light emitting devices selectively in a predetermined pattern.

37. The composite serial lamp set as claimed in claim 36, wherein said non-electrical connector is tied and fixed onto said conductive wire.

38. The composite serial lamp set as claimed in claim 36, wherein said non-electrical connector is fixed onto said conductive wire by a clamp base.

39. The composite serial lamp set as claimed in claim 23, wherein said at least one conductive wire is stranded and wound with at least one other non-electrical connector within a predetermined distance to define an opening, such that a support object passes through said opening and said support object is secured into a fixed position by a twisting force.

40. The composite serial lamp set as claimed in claim 39, wherein said support object is a tree-shaped object.

41. The composite serial lamp set as claimed in claim 23, wherein further comprising a decorative object disposed on said non-electrical connector and wound between said conductive wires.

42. A composite serial lamp, comprising:

a serial lamp set;

at least one non-electrical connector coupled with said serial lamp set, said non-electrical connector comprising a plurality of non-conductive strands to define a bundled wire, and an insulating jacket layer wrapping around said bundled wire to define a sheath wire, and said serial lamp set is comprised of a plurality of conductive wires connected to a plurality of light emitting devices and a power supply device, thereby said non-electrical connector and serial lamp set being stranded and wound into a plurality of fixed positions of said serial lamp set to arrange said serial lamp set selectively into a predetermined pattern.

* * * * *